United States Patent [19]

Churchward

[11] 4,340,230

[45] Jul. 20, 1982

[54] WEIGHTED GOLF IRON

[76] Inventor: Roy A. Churchward, 6444 Nineteenth Ave. South, Minneapolis, Minn. 55432

[21] Appl. No.: 232,115

[22] Filed: Feb. 6, 1981

[51] Int. Cl.[3] ..... A63B 53/04

[52] U.S. Cl. ..... 273/171

[58] Field of Search ..... 273/77 R, 167 F, 169, 273/171, 172

[56] References Cited

U.S. PATENT DOCUMENTS

| | | | |
|---|---|---|---|
| Re. 19,178 | 5/1934 | Spiker | 273/169 X |
| 1,453,503 | 5/1923 | Holmes | 273/171 |
| 2,254,528 | 9/1941 | Hoare | 273/169 X |
| 2,332,342 | 10/1943 | Reach | 273/171 |
| 2,360,364 | 10/1944 | Reach | 273/171 |
| 2,517,245 | 8/1950 | Scott | 273/171 |
| 3,096,982 | 7/1963 | Bassin | 273/171 X |
| 3,143,349 | 8/1964 | MacIntyre | 273/171 |
| 3,387,845 | 6/1968 | Raub | 273/171 X |

FOREIGN PATENT DOCUMENTS

| | | | |
|---|---|---|---|
| 646942 | 8/1962 | Canada | 273/171 |
| 413024 | 7/1934 | United Kingdom | 273/171 |
| 414516 | 8/1934 | United Kingdom | 273/169 |
| 439187 | 12/1935 | United Kingdom | 273/171 |

*Primary Examiner*—Richard J. Apley

*Attorney, Agent, or Firm*—Norman P. Friederichs

[57] ABSTRACT

A golf club iron is provided including a variable weighting system. The weights are disposed in selected openings in a matrix. A cover secures the weights in place. The cover is in a protected position to the rear of the club head.

9 Claims, 5 Drawing Figures

FIG. I
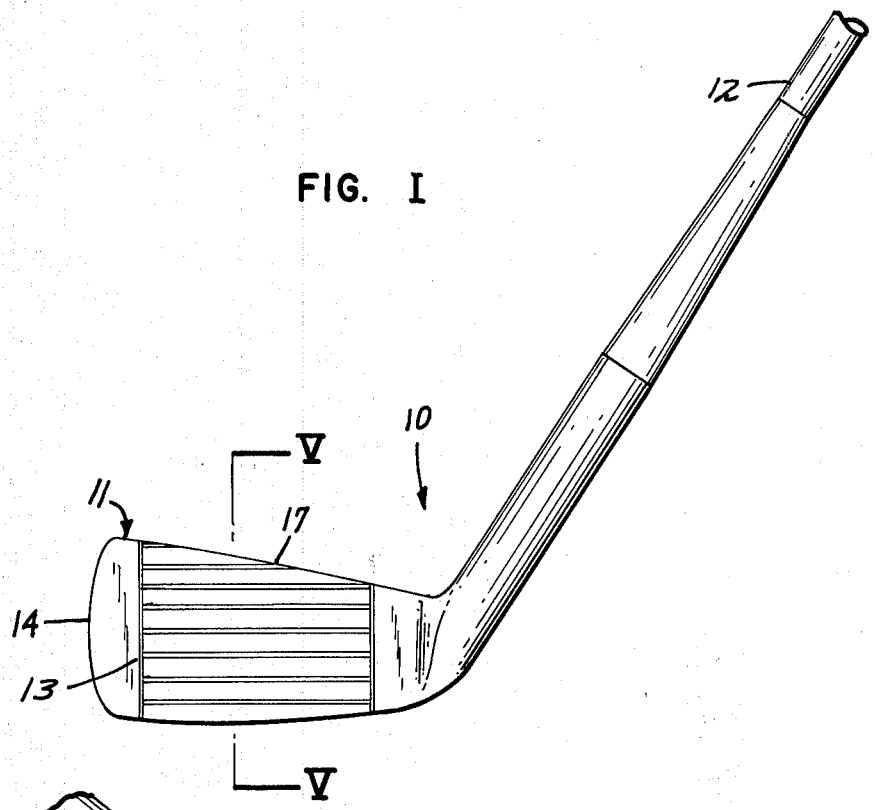
FIG. II
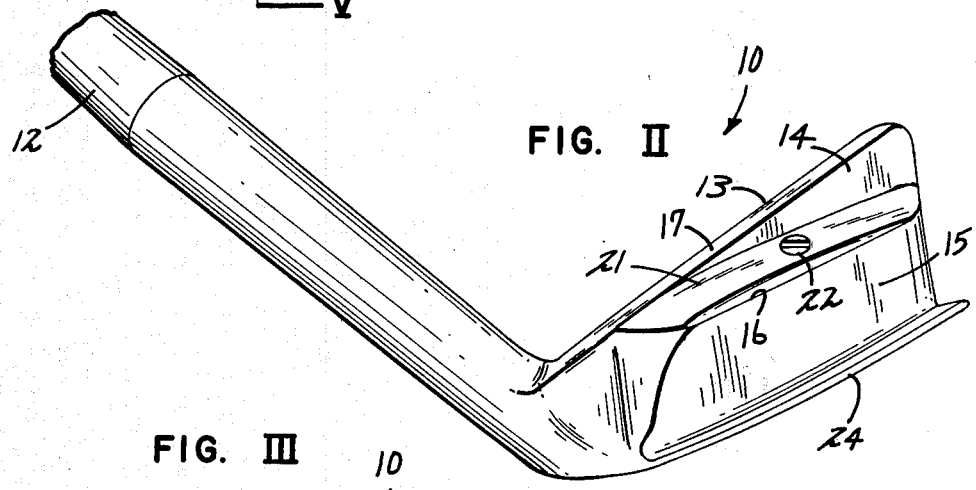
FIG. III
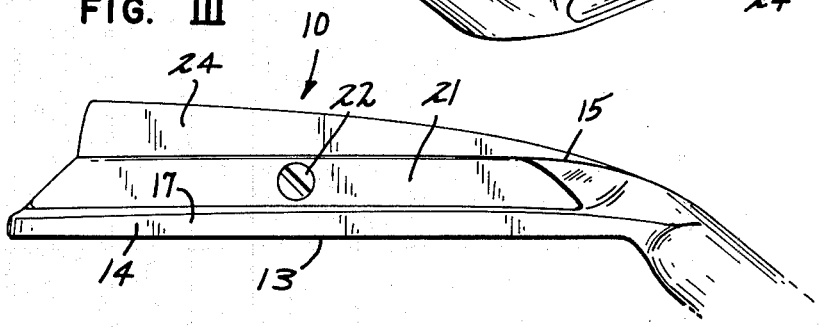

FIG. IV
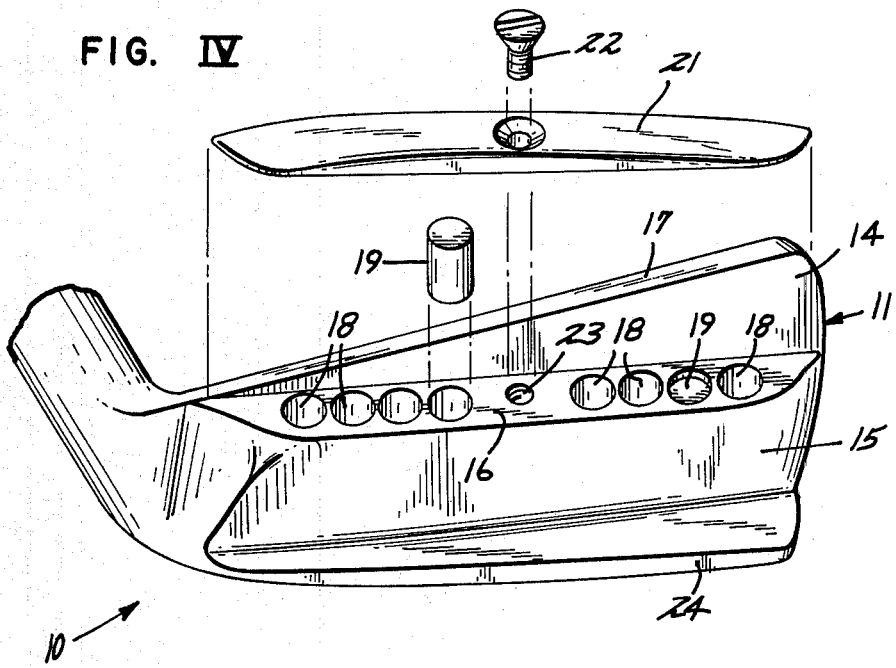
FIG. V
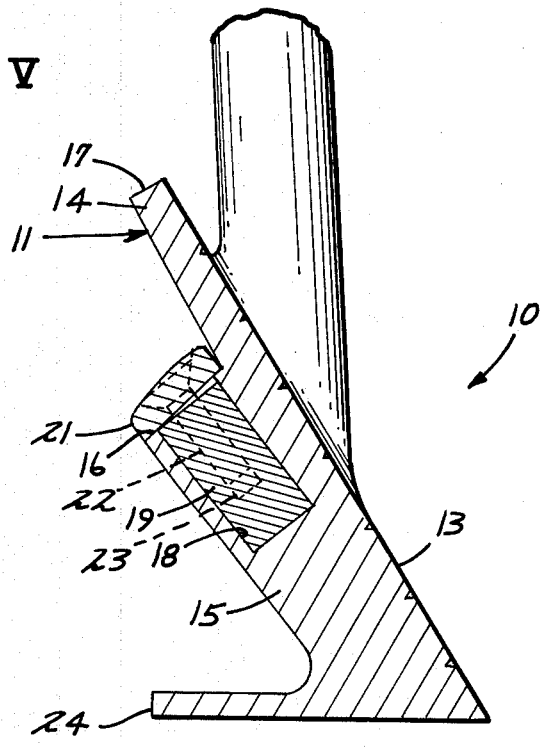

WEIGHTED GOLF IRON

BACKGROUND OF THE INVENTION

The present invention relates to golf clubs of the type generally referred to as irons. The present invention more particularly relates to a golf club iron including a variable weighting system.

The sport of golf has developed into a highly specialized sport in which an individual golfer may be fitted with a set of clubs sized and weighted for the golfer's height, strength, and style of swing. A set of golf clubs generally will include clubs of the type known as woods and clubs of the type known as irons.

A golf club professional or pro may analyze the individual golfer's swing to determine the size and weight of the clubs that best fit that individual. The pro may then order the appropriate clubs from a manufacturing company. All too often the fitting may not be completely satisfactory and the golf pro or the individual golfer being fitted must decide whether to purchase a second differently weighted set of clubs which more closely meet the desires of the individual golfer. The variable weighted woods disclosed in my U.S. Pat. Nos. 4,053,563 and 4,085,934 solve this problem in the case of woods. These patents show a wood having a module disposed in the club head with access being provided to the module by means of a removable cap. The cap is a portion of the sole plate. This arrangement permits the addition and removal of weights to fit the individual golfer and also permits shifting of the weight within the head of the golf club to better fit the swing of the individual golfer.

The problems encountered in weighting of a golf club iron are distinct from those encountered in the weighting of a wood. A golf iron does not have a sole plate. A golf iron has a relatively thin, horizontal profile as compared with a wood and thus one may encounter difficulty in attempting to include a sole plate on a golf iron. In view of this, the approach for variable weighting shown in my U.S. Pat. Nos. 4,043,563 and 4,085,934 would not be readily applicable to an iron.

One approach for weighting a golf club iron is shown in U.S. Pat. No. 2,328,583 (Reach) in which a plurality of holes are provided along a lower portion of a gold club iron and a very narrow bottom plate is mounted thereover. It is to be recognized that tremendously high force would be applied to the narrow bottom plate should one top the golf ball and strike the ball only with such bottom plate. The force may very well tear away such a bottom plate. Moreover, if one were to move this bottom plate to the upper surface of the golf club head, one may at times swing beneath the ball such that only the plate would contact the ball, thereby again subjecting the plate to excessive forces. Also, dirt and grass impacting between the cover and the iron tend to warp the cover, thereby creating weighting and repair problems.

GENERAL DESCRIPTION OF THE PRESENT INVENTION

The present invention overcomes the disadvantages encountered in previous attempts to provide a variable weight golf iron. The present invention provides a golf club iron including a head, a shaft and grip portion. The head has a forwardly facing surface for striking the golf ball. The golf club further includes a weighting system disposed along the rear side of the golf club head. The weighting arrangement includes a thickened portion having a plurality of openings defined therein, with weights selectively inserted into such openings. A cap overlies and is secured in place to cover the openings. The weights may be disposed, if desired, approximately midway in elevation with respect to the face of the club. This cap is secured over said openings to prevent dislodgement of said weights, said cap being located in a protected position at the rear of said club head.

In the drawings:

FIG. I is a front view of a golf club iron according to the present invention;

FIG. II is a rear view of the present invention;

FIG. III is a top view of the present invention;

FIG. IV is an enlarged, exploded view from the rear of the present invention;

FIG. V is a cross sectional view taken along the line V—V in FIG. I.

DETAILED DESCRIPTION OF THE PRESENT INVENTION

The golf club iron 10 of the present invention, one embodiment of which is shown in FIGS. I–V, includes a club head 11 and a shaft 12. The shaft 12 may include a suitable grip portion. The shaft 12 is stiff, yet flexible and typically is made of a light weight tubular spring steel.

The club head 11 has a face 13 provided with a suitable pitch to provide the desired loft of a ball when in use. The pitch may be any of the numerically designated pitches such as 1 through 9. The present clubs may also be provided in the form of wedges, typically the pitching wedge and sand wedge. The face of the club head 11 may have a plurality of horizontal furrows which aid in control of the golf ball.

The club head 11 includes a blade like portion 14 which provides a forwardly directed face 13. The blade-like portion 14 may be similar to the club head of a conventional golf iron. The club head 11 futher includes a thickened matrix portion 15 which is intergral with the blade portion 14. The upper edge of the thickened matrix 15 is spaced downwardly from the upper edge 17 of the blade portion 14.

The matrix 15 has a plurality of openings such as opening 18 disposed therein for reception of weights 19. The weights 19 may be of a shape and size to fit snuggly within the openings 18 thereby minimizing any noise from movement of weights within the opening 18. The weights 19 may be cylindrical in shape and may be disposed with their axes parallel with the face of the club head. A cap 21 is disposed over the upper surface 16 of module 15. The cap 21 may be secured to the module 15 by one or more screws 22 which are threadedly engaged in an opening 23. The weights 19 may be sizes such as one-half swing weight, one swing weight, and the like.

The club head 11 may include an elongated foot portion 24 which provides for stability of the club. Of course, various modifications may be made without departing from the broader aspects of the present invention.

What is claimed is:

1. A golf club iron comprising a club head and a shaft, said club head including a blade-like portion and a thickened matrix portion, said blade-like portion having an upper exposed edge, said thickened matrix portion defining a plurality of vertically oriented, downwardly extending openings, a plurality of vertically oriented, elongated, removable weights slidably disposed in selected of said openings and a cap disposed over said thickened portion to cover said openings, said cap being secured in place by screw means, said cap having an upper surface which is disposed lower than said blade upper exposed edge, said thickened matrix being disposed in the intermediate rear portion of said club head whereby said cap is disposed in a protected zone at the rear of said club head.

2. The golf club iron of claim 1 wherein said openings comprise a plurality of aligned openings.

3. The golf club iron of claim 2 wherein said weights are cylindrically shaped and are snugly received in said openings.

4. The golf club iron of claim 3 wherein said club head has an elongated plate-like foot portion extending rearwardly from said blade portion.

5. A golf club iron comprising a blade-like club head including a club face and a shaft including a grip portion, said blade-like club head having an upper edge, said club head having a weight-receiving matrix with a plurality of vertically oriented openings disposed to the rear of said club head, a plurality of slidable weights removably disposed in selected of said openings, a cap closing said openings to prevent dislodgement of said weights, said cap being entirely located lower than said upper edge in a protected position to the rear of said club head.

6. The golf club iron of claim 5 wherein said openings comprise a plurality of aligned openings.

7. The golf club iron of claim 5 wherein said cap is secured to said club head by screw means.

8. The golf club iron of claim 5 wherein said weights are cylindrical in shape and tightly received in said openings.

9. The golf club iron of claim 8 wherein the center axis of each cylindrical weight is substantially parallel with the face of said club head.

* * * * *